US006320164B2

(12) United States Patent
Millett

(10) Patent No.: US 6,320,164 B2
(45) Date of Patent: Nov. 20, 2001

(54) OVEN WINDOW INCLUDING A THERMALLY ACTIVATED, LIGHT SCATTERING DEVICE

(75) Inventor: Fred A. Millett, Grand Haven, MI (US)

(73) Assignee: Pilkington North America, Inc., Toledo, OH (US)

( * ) Notice: Subject to any disclaimer, the term of this patent is extended or adjusted under 35 U.S.C. 154(b) by 0 days.

(21) Appl. No.: 09/796,156

(22) Filed: Feb. 28, 2001

Related U.S. Application Data

(60) Provisional application No. 60/187,364, filed on Mar. 6, 2000, and provisional application No. 60/187,365, filed on Mar. 6, 2000.

(51) Int. Cl.[7] ..... F23M 7/00; F24C 15/04; A21B 3/02; F27D 1/18; H05B 3/26

(52) U.S. Cl. ..... 219/391; 219/405; 126/200

(58) Field of Search ..... 219/391, 393, 219/395–397, 405, 520, 522; 126/190, 198, 200; 432/250

(56) References Cited

U.S. PATENT DOCUMENTS 5,337,727 * 8/1994 Borens et al. ..... 126/200
5,588,421 * 12/1996 Busch et al. ..... 126/200

FOREIGN PATENT DOCUMENTS 1-18946 * 1/1989 (JP) .
9-48640 * 2/1997 (JP) .

* cited by examiner

*Primary Examiner*—Joseph Pelham
(74) *Attorney, Agent, or Firm*—Marshall & Melhorn, LLC

(57) ABSTRACT

An oven view window comprising a glass substrate, and having disposed on a major surface thereof, a thermally activated, light-scattering coating which, when at a temperature below the activation temperature of the coating is translucent-to-opaque in appearance, but when at a temperature above the activation temperature of the coating is essentially transparent in appearance. Optionally, an infrared reflective coating and a color suppressing coating may also be deposited, in a variety of configurations, onto the oven view window carrying the thermally activated, light-scattering coating.

36 Claims, 1 Drawing Sheet

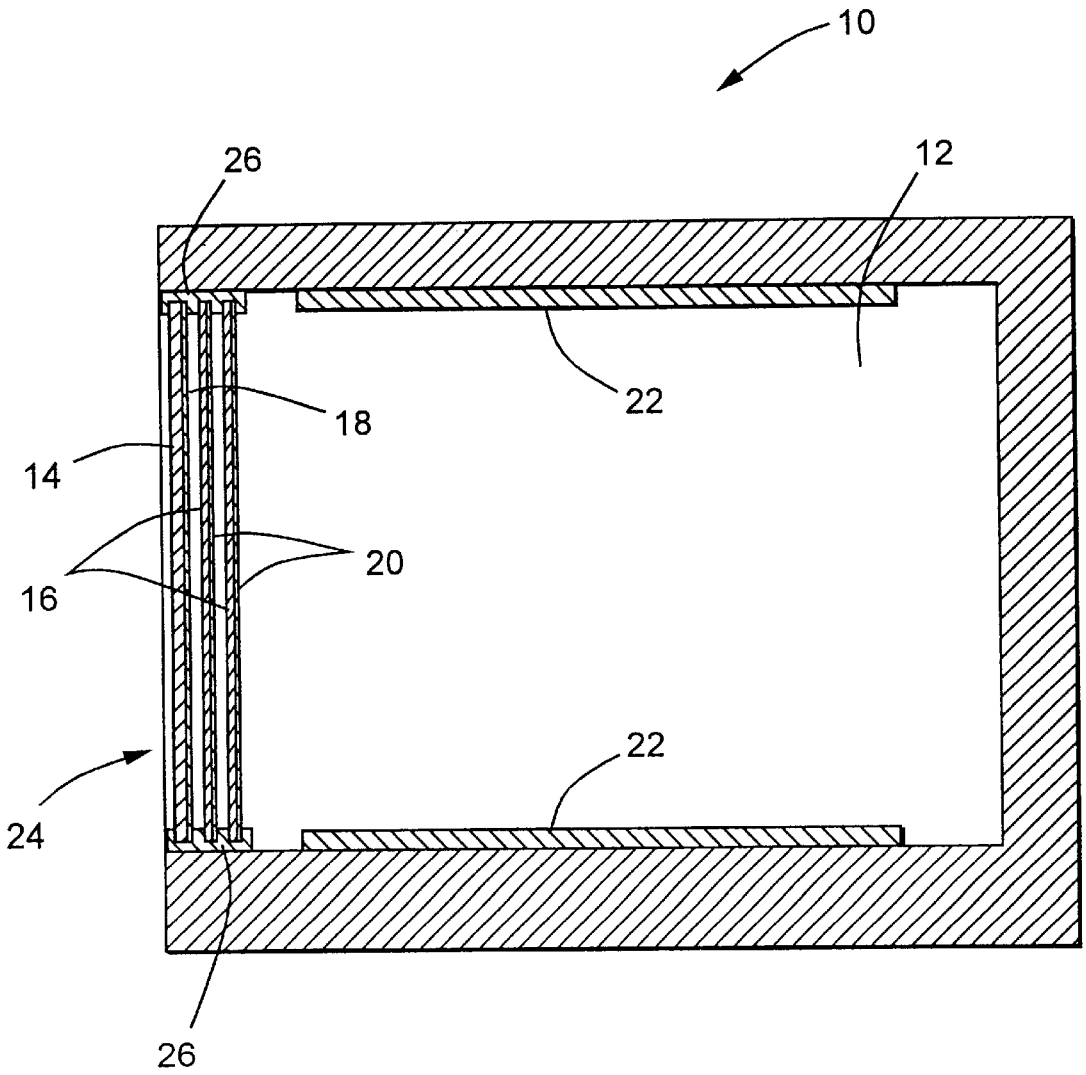
10
26
12
22
18
14
20
16
22
24
26

OVEN WINDOW INCLUDING A THERMALLY ACTIVATED, LIGHT SCATTERING DEVICE

This application is claiming benefit under 35 U.S.C. § 119(e), of the provisional application filed Mar. 6, 2000, under 35 U.S.C. 111(b), which was granted a serial number of 60/187,364. Provisional application serial No. 60/187,365 filed Mar. 6, 2000 is hereby incorporated by reference.

BACKGROUND

View windows of various sizes and having various structures have long been used in oven doors. In order to meet applicable safety standards for allowable exterior temperatures of said view windows, however, they have typically been small in size, deeply tinted, or otherwise treated so that the view into the cooking chamber is very limited, thus creating a periodic need to open the oven door to check the progress of the item or items that are being cooked. Each time the oven door is opened, the interior temperature of the cooking chamber decreases below the desired cooking temperature, and additional energy is consumed in returning the temperature to such desired temperature. Additionally, the hot cooking chamber can pose a safety risk to small children or others who are not aware of the risk of being burned when the oven door is open.

Accordingly, it would be advantageous to have an oven view window which would meet applicable safety standards, but would allow a substantial size view window being essentially transparent to enable the user to have a clear and expansive view of the items of food being cooked so that it is unnecessary to open the oven door to check the progress of such items.

SUMMARY OF THE INVENTION

The present invention relates to a view window in an oven, the view window comprising a glass substrate having two major surfaces and a thermally activated, light scattering coating disposed on at least one of the major surfaces. More particularly, the glass substrate carries a normally translucent-to-opaque coating which upon exposure to heat becomes essentially transparent.

One important quality of the window is its ability to provide improved viewing to the interior of the oven cooking chamber, and food items located in such chamber. Additionally, a plurality of glass substrates inside the oven door should reflect/absorb the heat generated in the interior of the oven during use and transmit as little as possible of that heat to the exterior surface of the oven door.

The present invention may beneficially be used in any type of oven in which sufficient heat is generated, when such oven is in operation, so as to heat the oven door to a temperature above the activation temperature of the thermally activated light-scattering coating.

The invention provides a view window that, when the oven is not in use or is at a temperature below a predetermined activation temperature, will appear translucent-to-opaque, thus masking the interior of the oven, i.e., the cooking chamber, from view. Upon exposure to a temperature above a predetermined activation temperature, however, the viewing window will appear color neutral and essentially transparent, clearly revealing the interior of the cooking chamber.

The advantages of the invention will become readily apparent to those skilled in the art from the following detailed description of a preferred embodiment when considered in the light of the accompanying drawing in which:

DESCRIPTION OF THE DRAWINGS

The FIGURE is a somewhat schematic side sectional view of an oven (10) which incorporates the invention.

DETAILED DESCRIPTION OF THE PREFERRED EMBODIMENT

In an oven (10), cooking chamber (12) is heated by one or more heating sources, such as that shown schematically at (22), in the conventional manner. Such heat energy is transferred throughout the cooking chamber, including to optional glass substrates, (16) and to glass substrate (14), which comprise in various embodiments oven view window (24). Suitable infrared reflective coatings (20) may be provided on one or both surfaces of optional substrates (16), thus reflecting some portion of the heat energy from heating source (22) back into cooking chamber (12). The glass substrate (14) or optional glass substrates (16) carry a suitable thermally activated light scattering coating (18) (shown only on substrate (14)) on at least one of two opposed parallel surfaces. Upon exposure to sufficient heat energy from heating source (22) such that when the surface carrying the thermally activated light scattering coating (18) reaches a predetermined activation temperature, it will change in appearance from translucent-to-opaque to essentially transparent.

The substrate (14) and optional substrates (16) each have first and second major surfaces in opposed relationship, and are in a spaced apart and mutually parallel relationship to one another.

Further, a frame (26) supports the substrate (14) and optional additional glass substrates (16) in a spaced apart and mutually parallel relationship. The frame (26) is attached to the oven door in a predetermined location.

An infrared reflective coating (20) is also desirably disposed on one major surface of optional substrate(s) (16) and a thermally activated light scattering coating (18) is disposed on the opposed major surface of the optional substrate(s) (16). Any additional glass substrates may also have infrared reflective coatings disposed on at least one, and preferably both, major surfaces. Such additional substrates would preferably be located in spaced apart mutually parallel relationship between the first and second substrates.

As noted above, the cooking chamber of the oven (12) includes one or more heating sources (22) capable of heating the interior of said cooking chamber (12) to at least the temperature necessary to activate the thermally activated light scattering coating (18). If the power to the heating sources (22) is decreased, or turned off so as to deactivate the heating sources, the previously activated coating (18) will, upon cooling, return to its "passive" condition, i.e., will be translucent-to-opaque. The cooking chamber (12) may also include one or more lighting sources (not shown) to aid viewing into the chamber (12) when the coating (18) is in an activated, i.e., essentially transparent, state.

In another embodiment (not shown), an electrically conductive film and a thermally activated light scattering film may both be disposed on the same major surface of a glass substrate such that the heat generated by the flow of electric current through the conductive film will activate the thermally activated light scattering film, causing it to go from the passive to the active mode., i.e., from translucent-to-opaque to essentially transparent in appearance.

Any suitable infrared reflective coating may optionally be utilized in connection with the present invention. A preferred infrared reflective coating is fluorine-doped tin oxide. An example of such a preferred infrared reflective coating is the fluorine doped tin oxide coating disclosed in U.S. Pat. No. 5,698,262, which is incorporated herein by reference, in its entirety.

Any suitable method of depositing an infrared reflective coating may be utilized. Preferably, the coating is a pyrolytic coating, deposited by the chemical vapor deposition method. Most preferably, said coating is color-suppressed, so as to minimize undesirable color reflectance, sometimes called iridescence.

Likewise, any suitable thermally activated light scattering coating may be utilized in connection with the present invention. Examples of such suitable coatings are thermally activated, polymer dispersed liquid crystals, cholesteric liquid crystals, and crystalline colloidal arrays. For example, crystalline colloidal arrays are disclosed in U.S. Pat. No. 6,014,246, which is incorporated herein by reference. The thermochromic opaque composition disclosed in U.S. Pat. No. 5,490,956 is another example of a potentially suitable coating compound, and is also incorporated herein by reference.

Such thermally-activated, light scattering coatings may be deposited by any suitable method. For example, spray coating or flow coating methods may be utilized.

The activation temperature of the thermally-activated, light scattering coating will be well above the ambient room temperature generally experienced in a home environment, e.g. 20–25° C. (70–77° F.). Preferably, the activation temperature will be above ambient room temperature experienced on a hot summer day in the U.S., e.g., 38° C. (100° F.). The activation temperature, however, is desirably below minimum temperatures at which food is typically cooked in an oven, e.g., 100° C. (212° F.). Accordingly, the activation temperature of the thermally activated light scattering coating is preferably in the range of 40–60° C. (104° F.–140° F.). The activation temperature is most preferably in the range of 42–50° C. (108° F.–122° F.). The thermally activated coating, once activated, should remain so, or be essentially transparent, through the range of normal cooking temperatures, up to say, at least, 218° C. (450° F.).

In accordance with the provisions of the patent statutes, the present invention has been described in what is considered to represent its preferred embodiment, however, it should be noted that the invention can be practiced otherwise than as specifically illustrated and described without departing from its spirit or scope.

What is claimed is:

1. An oven view window comprising a transparent substrate having a thermally activated light scattering coating applied thereto, said coating being translucent-to-opaque below a desired activation temperature and essentially transparent above said temperature.

2. The oven view window as defined in claim 1, wherein the activation temperature of said coating is 38° C. or above.

3. The oven view window as defined in claim 1 wherein said transparent substrate is glass.

4. The oven view window as defined in claim 1 wherein said thermally activated light scattering coating comprises: thermally activated polymer dispersed liquid crystals, cholesteric liquid crystals, or crystalline colloidal arrays.

5. The oven view window of claim 2 wherein the activation temperature of said thermally activated light scattering coating is less than 100° C.

6. The oven view window of claim 5 wherein the activation temperature of said light scattering coating is in the range of 40–60° C.

7. The oven view window of claim 2 wherein an activation means for one or more lighting sources within the oven heating chamber is provided, such that when said thermally activated light scattering coating is activated, said one or more lighting sources is (are) simultaneously activated.

8. The oven view window of claim 1, wherein an electrically conductive film is disposed on the same major surface of the transparent substrate upon which said thermally activated light scattering coating is disposed.

9. The oven view window of claim 8, wherein a source of electrical current is selectively provided to said electrically conductive film such that the flow of said electrical current through said conductive film creates heat energy.

10. The oven view window of claim 9 wherein the heat energy created by the flow of said electrical current through said electrically conductive film is sufficient to activate said thermally activated light scattering coating.

11. An oven view window comprising two or more transparent substrates wherein said transparent substrates are in a spaced apart and mutually parallel relationship, one to another, and a thermally activated light scattering coating is disposed on a major surface of at least one transparent substrate.

12. The oven view window of claim 11 wherein an infrared reflective coating is disposed on one or more major surfaces of said two or more transparent substrates.

13. The oven view window of claim 12, wherein said infrared reflective coating is comprised of fluorine-doped tin oxide.

14. The oven view window of claim 13, wherein said infrared reflective coating is applied to said oven view window by a deposition method chosen from the group consisting of: spray coating, vacuum coating, and chemical vapor deposition.

15. The oven view window of claim 11 wherein a color suppressing coating is disposed on one surface of one or more transparent substrates prior to the deposition of the infrared reflective coating, thereon.

16. The oven view window of claim 15, wherein said color suppressing coating comprises a silicon layer disposed directly on a surface of one of said transparent substrates, and a metal oxide layer disposed directly onto said silicon layer.

17. The oven view window of claim 16, wherein said metal oxide is tin oxide.

18. The oven view window of claim 16, wherein said silicon and metal oxide layers are each deposited on said one or more transparent glass substrates by the process of chemical vapor deposition.

19. An oven having a heating chamber which includes an oven door for selectively providing access to said heating chamber and an oven view window mounted in said oven door, said oven view window comprising a transparent substrate having a thermally activated light scattering coating applied thereto, said coating being translucent-to-opaque below a desired activation temperature and essentially transparent above said temperature.

20. The oven of claim 19 wherein said transparent substrate comprising said oven view window is glass.

21. The oven of claim 19 wherein said activation temperature of said thermally activated, light-scattering coating is 38° C. or above.

22. The oven of claim 21 wherein the activation temperature of said thermally activated, light-scattering coating is less than 100° C.

23. The oven of claim 22 wherein the activation temperature of said thermally activated coating is in the range of 40–60° C.

24. The oven of claim 19 wherein said thermally activated light-scattering coating comprises thermally activated polymer dispersed liquid crystals, cholesteric liquid crystals or crystalline colloidal arrays.

25. The oven of claim 19 wherein an activation means for one or more lighting sources within said oven heating chamber is provided, such that when said thermally activated light-scattering coating is activated, said one or more lighting sources is (are) simultaneously activated.

26. The oven of claim 19, wherein an electrically conductive film is disposed on the same major surface of the transparent substrate upon which said thermally activated light-scattering coating is disposed.

27. The oven of claim 26 wherein a source of electrical current is selectively provided to said electrically conductive film such that the flow of said electrical current through said conductive film creates heat energy.

28. The oven of claim 27 wherein the heat energy created by the flow of said electrical current through said electrically conductive film is sufficient to activate said thermally activated light-scattering coating.

29. An oven comprising a heating chamber having an opening, said opening covered by a door, said door having a view window, said view window further comprising two or more transparent substrates wherein said transparent substrates are in a spaced apart and mutually parallel relationship, one to another, and a thermally activated light scattering coating is disposed on one or more major surface of at least one of said transparent substrates.

30. The oven of claim 29 wherein an infrared reflective coating is disposed on one or more major surfaces of said two or more transparent substrates.

31. The oven of claim 30 wherein said infrared reflective coating is comprised of fluorine-doped tin oxide.

32. The oven of claim 31 wherein said infrared reflective coating is applied to said oven view window by a deposition method chosen from the group consisting of: spray coating, vacuum coating, and chemical vapor deposition.

33. The oven of claim 29 wherein a color suppressing coating is disposed on one surface of one or more transparent substrates prior to the deposition of the infrared reflective coating thereon.

34. The oven of claim 33 wherein said color suppressing coating comprises a silicon layer disposed directly on a surface of one of said transparent substrates, and a metal oxide layer disposed directly onto said silicon layer.

35. The oven of claim 34 wherein said metal oxide is tin oxide.

36. The oven of claim 34, wherein said silicon and metal oxide layers are each deposited on said one or more transparent glass substrates by the process of chemical vapor deposition.

* * * * *